US007121917B2

(12) United States Patent
Hardouin et al.

(10) Patent No.: US 7,121,917 B2
(45) Date of Patent: Oct. 17, 2006

(54) CONCEALED ATTACK VEHICLE SYSTEM

(75) Inventors: Christopher Hardouin, Los Angeles, CA (US); Ami N. Shapiro, Sherman Oaks, CA (US); Kevin M. Bloomfield, Valencia, CA (US); Yuval Caspi, Los Angeles, CA (US)

(73) Assignee: MGA Entertainment, Inc., Van Nuys, CA (US)

( * ) Notice: Subject to any disclaimer, the term of this patent is extended or adjusted under 35 U.S.C. 154(b) by 147 days.

(21) Appl. No.: 10/884,151

(22) Filed: Jul. 1, 2004

(65) Prior Publication Data

US 2006/0003666 A1 Jan. 5, 2006

(51) Int. Cl.
*A63H 17/25* (2006.01)
*A63H 17/273* (2006.01)

(52) U.S. Cl. ..... 446/470; 446/270; 446/288; 446/456; 446/462

(58) Field of Classification Search ..... 446/269, 446/270, 275, 279, 288, 456, 462, 470
See application file for complete search history.

(56) References Cited

U.S. PATENT DOCUMENTS 3,675,366 A 7/1972 Tomiyama
3,731,428 A 5/1973 Glass et al.
3,959,920 A 6/1976 Ieda
4,183,174 A 1/1980 Barris et al.
4,188,748 A 2/1980 Rich et al.
4,189,864 A 2/1980 Saito
4,540,379 A 9/1985 Tachibana
4,911,669 A 3/1990 Parker
4,919,639 A 4/1990 Hesse
4,986,789 A 1/1991 Hang
5,055,082 A * 10/1991 Varner ..... 446/308
5,310,379 A * 5/1994 Hippely et al. ..... 446/279
5,322,469 A 6/1994 Tilbor
5,334,078 A 8/1994 Hippely et al.
5,380,231 A 1/1995 Brovelli
5,383,810 A 1/1995 Loving
5,435,768 A 7/1995 Dunleavy
5,474,486 A 12/1995 Chilton et al.
5,580,296 A 12/1996 Chow
5,586,924 A * 12/1996 Huang ..... 446/462
5,713,783 A 2/1998 Szoke et al.
5,727,986 A 3/1998 Stubenfoll et al.
5,785,576 A 7/1998 Belton
5,816,887 A 10/1998 Rudell et al.
5,816,888 A 10/1998 Myer
5,951,363 A 9/1999 Uetake
5,989,096 A 11/1999 Barton et al.
6,036,575 A 3/2000 Rehkempere et al.
6,106,361 A 8/2000 Petris
6,264,528 B1 7/2001 Doan et al.
6,280,280 B1 8/2001 Vicino et al.
6,383,054 B1 5/2002 Rauch (Continued)

*Primary Examiner*—John A. Ricci
(74) *Attorney, Agent, or Firm*—IP Law Office of Joel D. Voelzke

(57) ABSTRACT

A remotely controlled concealed attack toy vehicle has a relatively normal appearance when the hood is closed; and arrangements are provided for raising the hood, and an armed attack figure is also raised, to present a threatening posture. The vehicle may have two rear drive wheels, which are independently operable by separate motors in the forward or reverse directions to permit rapid swiveling. A third idler wheel may be provided toward the front of the vehicle. A third motor may be provided to raise and lower the hood and the action figure, with an optional lost motion mechanism for delayed raising of the attack figure.

19 Claims, 13 Drawing Sheets

U.S. PATENT DOCUMENTS 6,551,169 B1 4/2003 Jaffe 6,582,275 B1 6/2003 Lai

* cited by examiner

FIG. 9
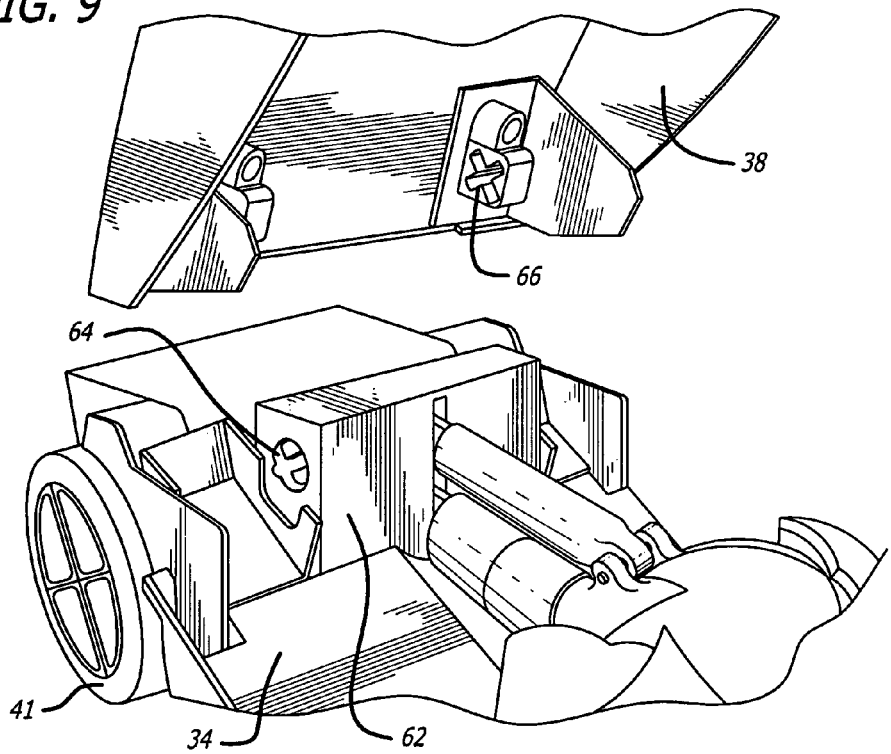
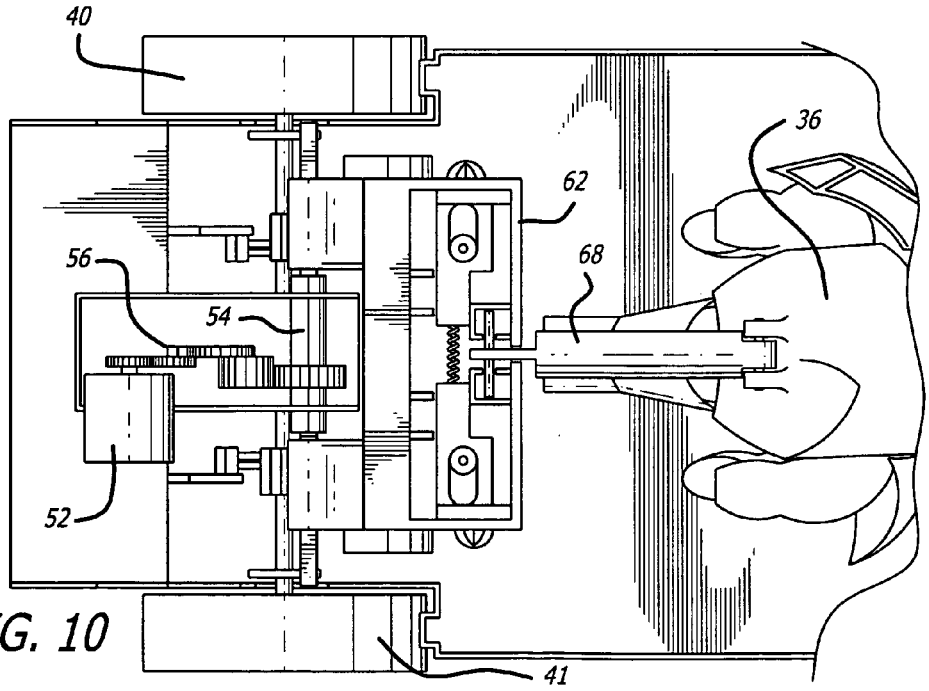
FIG. 10

FIG. 19
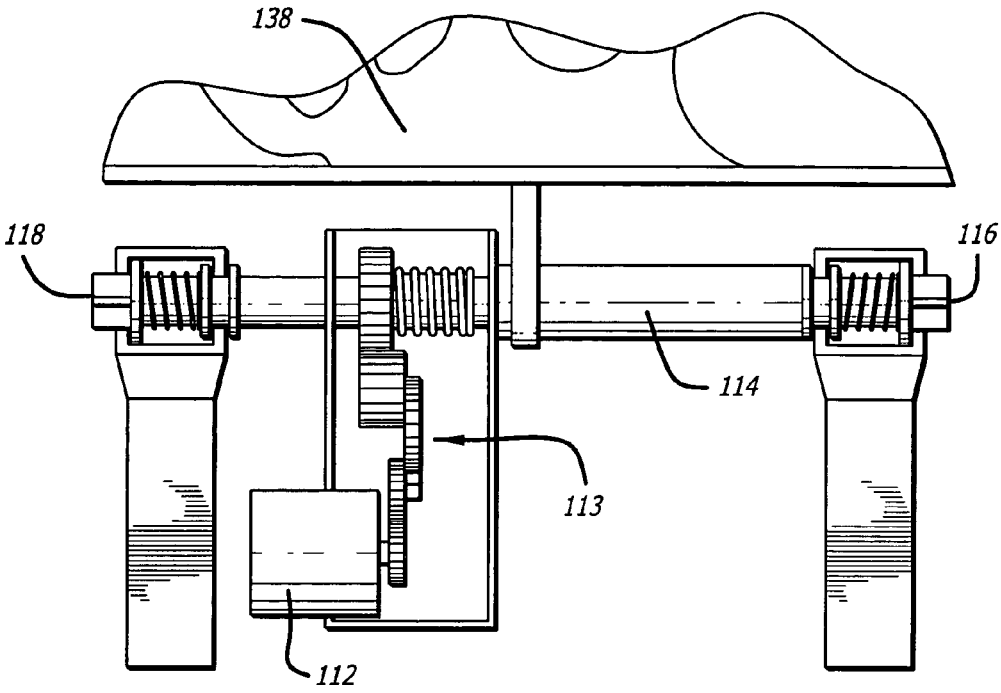
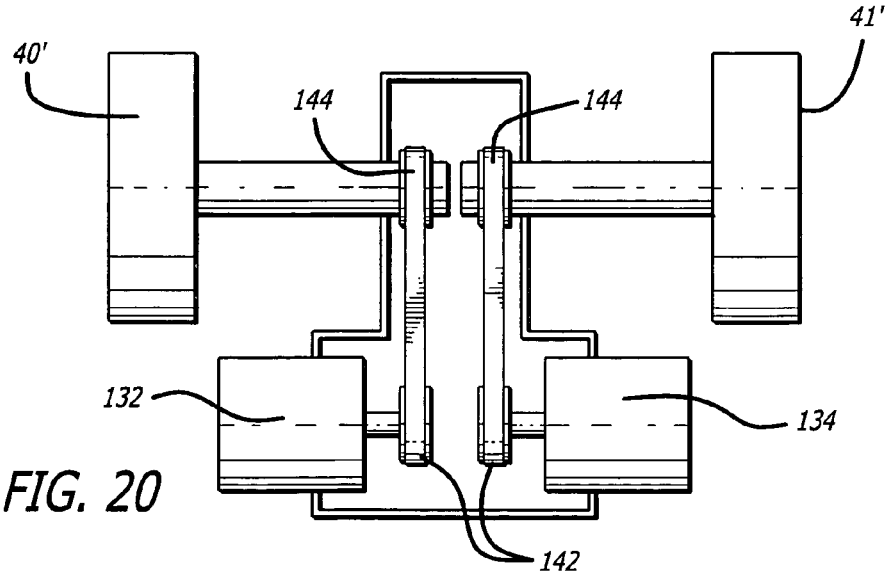
FIG. 20

CONCEALED ATTACK VEHICLE SYSTEM

FIELD OF THE INVENTION

This invention relates to toy vehicles and more particularly to toy vehicles for providing a surprise attack or threat.

BACKGROUND OF THE INVENTION

It has previously been proposed to provide toy vehicles having exploding characteristics, and U.S. Pat. No. 5,816,888 show one such toy. Attention is also directed to U.S. Pat. No. 5,334,078 which shows a vehicle with crocodile teeth and using a wing structure which is raised as the exposed jaws of the vehicle are opened. Also, U.S. Pat. No. 5,474,486 shows a vehicle in which the inside of the hood of a toy vehicle is in the form of a creature which squirts water when the hood is raised.

SUMMARY OF THE INVENTION

In accordance with an illustrative embodiment of the present invention, a concealed attack vehicle includes a hood which presents a relatively innocuous appearance when closed. When the hood is raised, an armed attack figure, spaced from the hood, is raised, and presents a threatening appearance.

The vehicle may be provided with three wheels, including first and second rear drive wheels, and a third front idler wheel. A remote controller may be provided to selectively energize first and second drive motors coupled, respectively, to the first and second drive wheels. The controller may also selectively control a third motor for raising and lowering the vehicle hood and the attack figure, and also may control weapon noise sound effects. A lost motion mechanism may be provided so that the third motor initially raises the hood of the vehicle, and subsequently raises the armed attack figure.

Other objects, features and advantages of the invention will become apparent from a consideration of the following detailed description, and from the accompanying drawings.

BRIEF DESCRIPTION OF THE DRAWINGS

FIG. 9 is an exploded diagrammatic showing, indicating how the hood is mounted on the chassis;

FIG. 10 is another view indicating the mode of operation of the mechanism for raising the attack figure;

FIG. 19 shows the motor for actuating the hood and the attack figure and indicates the step-down gearing from the motor to a rotatable shaft;

FIG. 20 shows the two motors for independently operating the two rear wheels of the attack vehicle;

DETAILED DESCRIPTION OF THE PREFERRED EMBODIMENTS

While the specification describes particular embodiments of the present invention, those of ordinary skill can devise variations of the present invention without departing from the inventive concept.

Figure 1:
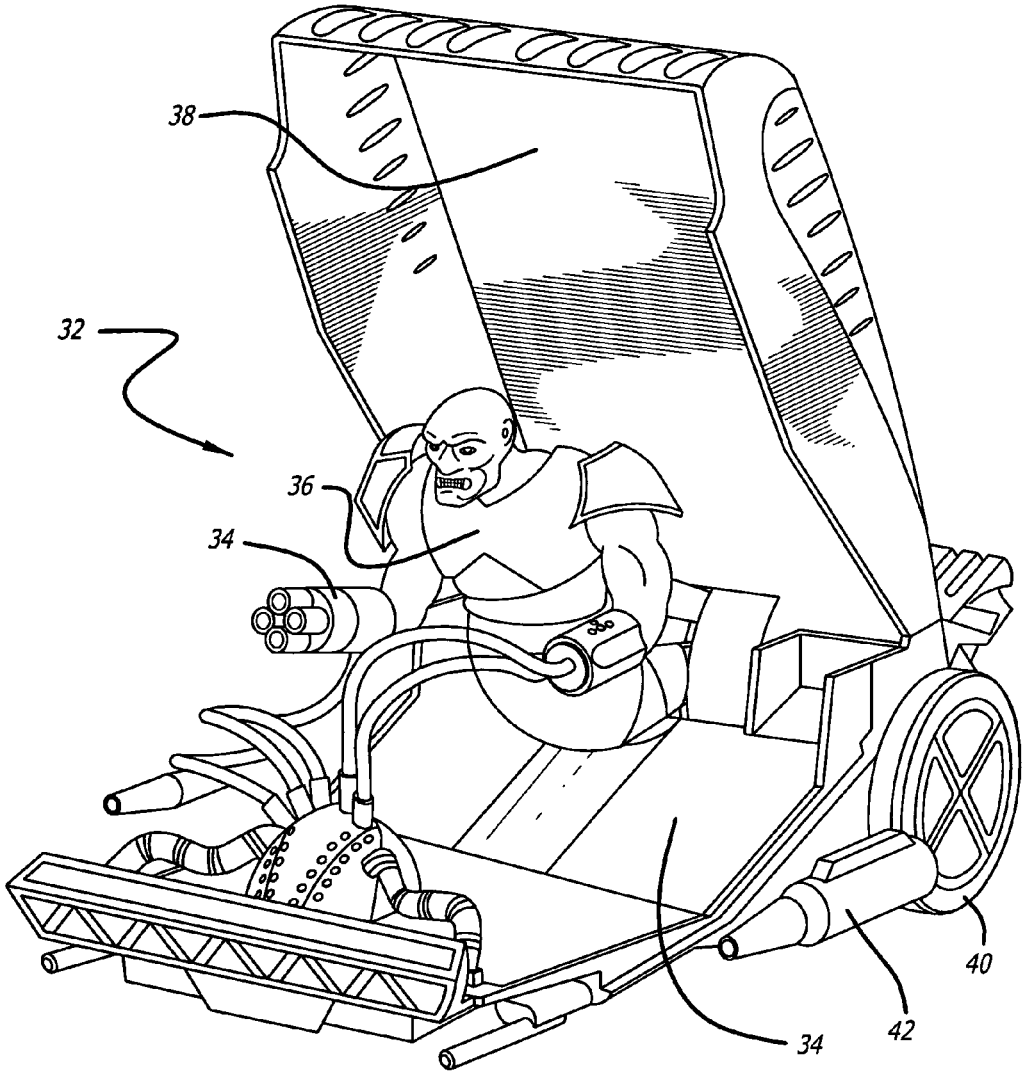
FIG. 1 is a perspective view of an attack vehicle system with the hood of the vehicle open and the armed attack figure in a raised threatening posture.

Referring now to FIG. 1 of the drawing, it is a perspective view showing the attack vehicle system 32 including the vehicle chassis 34 and the attack FIG. 36. When the hood is down, the action FIG. 36 is concealed, but when the hood 38 is raised the action FIG. 36 is concurrently or slightly subsequently raised to present a threatening attack appearance.

One large wheel 40 shown mounted at the rear of the vehicle has a companion wheel at the other side of rear of the vehicle, not shown. Mounted on the sides of the vehicle are weapons 42. In addition, the action figure has weapons 34 available for launching. As developed hereinbelow, sound effects are provided so that the noise of operation of the weapons is simulated.

Figure 2:
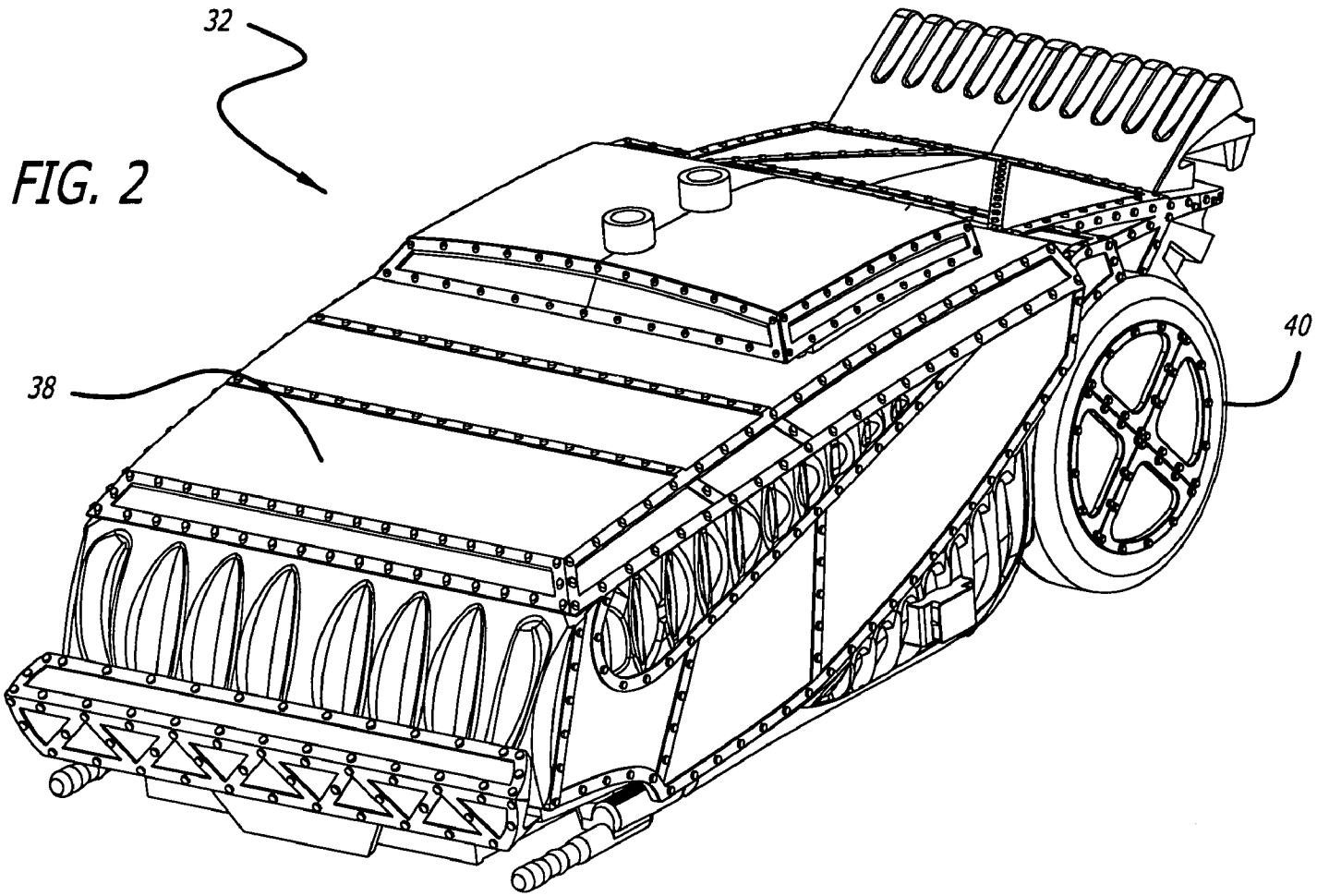
FIG. 2 is a perspective view of the vehicle of FIG. 1 with the hood closed.

FIG. 2 is a perspective view of the attack vehicle 32, with the hood 38 being closed, and the rear wheel 40 being visible as in the case of perspective view of FIG. 1.

Figure 3:
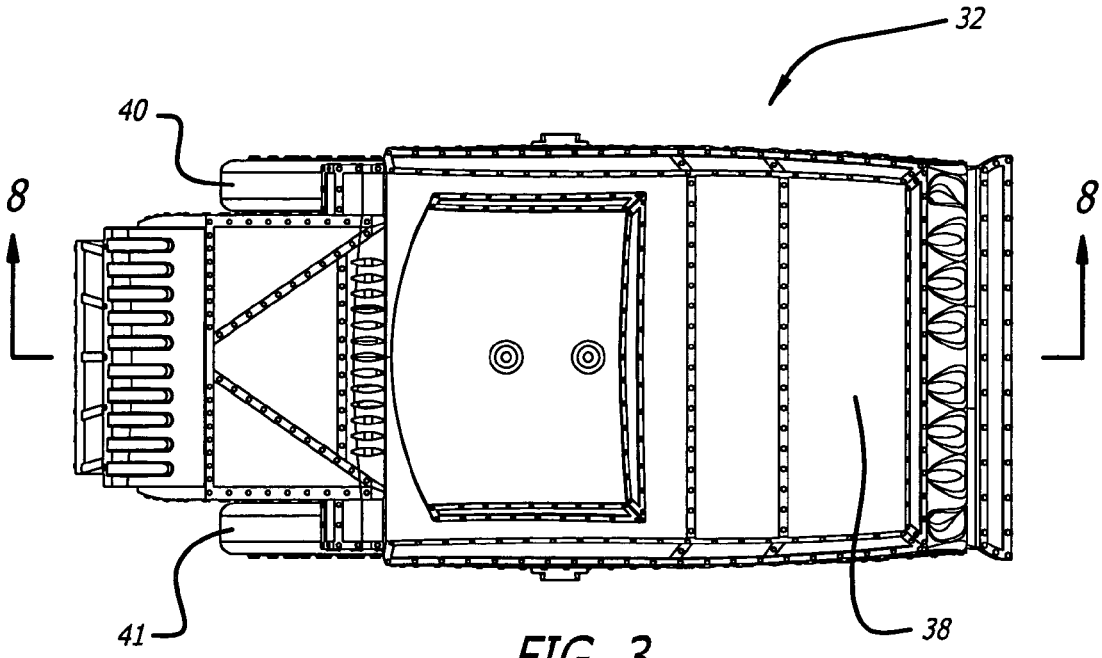
FIG. 3 shows a top view of the attack vehicle of FIGS. 1 and 2 with the hood closed.

FIG. 3 is a top plan view of the attack vehicle 32 with the hood 38 and the rear wheels 40 and 41 being clearly visible.

Figure 4:
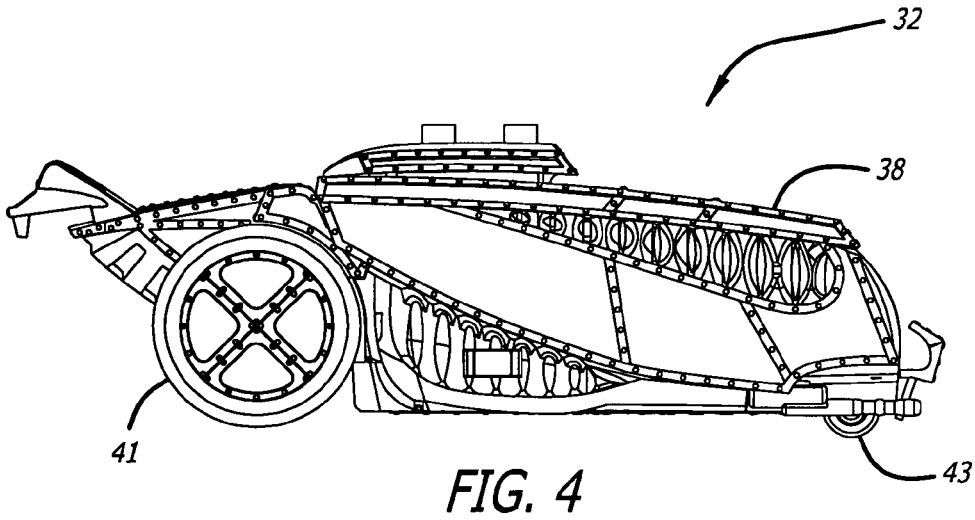
FIG. 4 shows a side view of the vehicle of FIG. 2.
Figure 5:
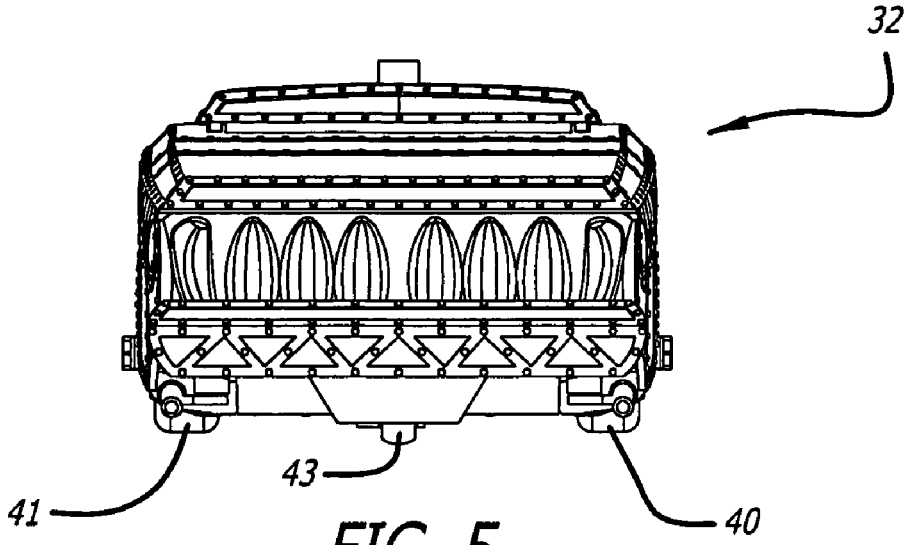
FIG. 5 is a front view of the vehicle of FIG. 2.
Figure 6:
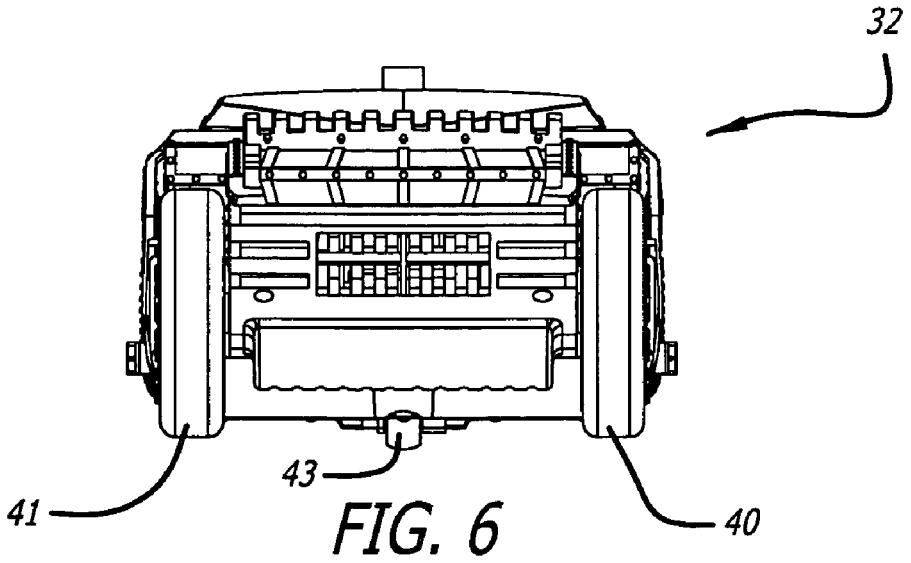
FIG. 6 is a rear view of the vehicle of FIG. 2.

FIG. 4 is a side view of the attack vehicle 32 with the hood 38, the rear wheel 41 and an additional front idler wheel 43 being visible. For completeness the front view 5 shows the idler wheel 43 and the two rear wheels 40 and 41, while the showing of FIG. 6 of the rear of the attack vehicle shows the two rear wheels 40 and 41 more prominently.

Figure 7:
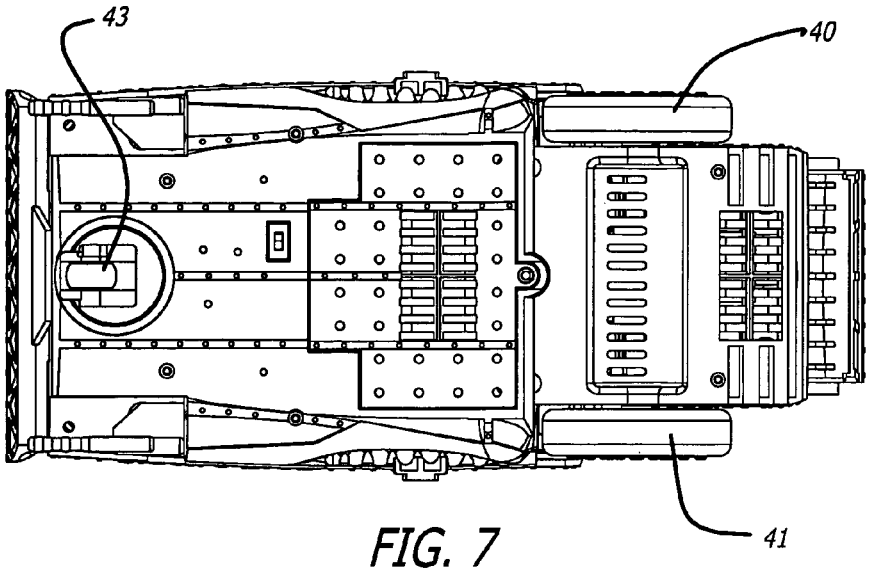
FIG. 7 is a bottom view of the attack vehicle of FIG. 2.

FIG. 7 is a bottom view of the attack vehicle 38 and clearly shows the two larger rear wheels 40 and 41 as well as the smaller front idler wheel 43.

Figure 8:
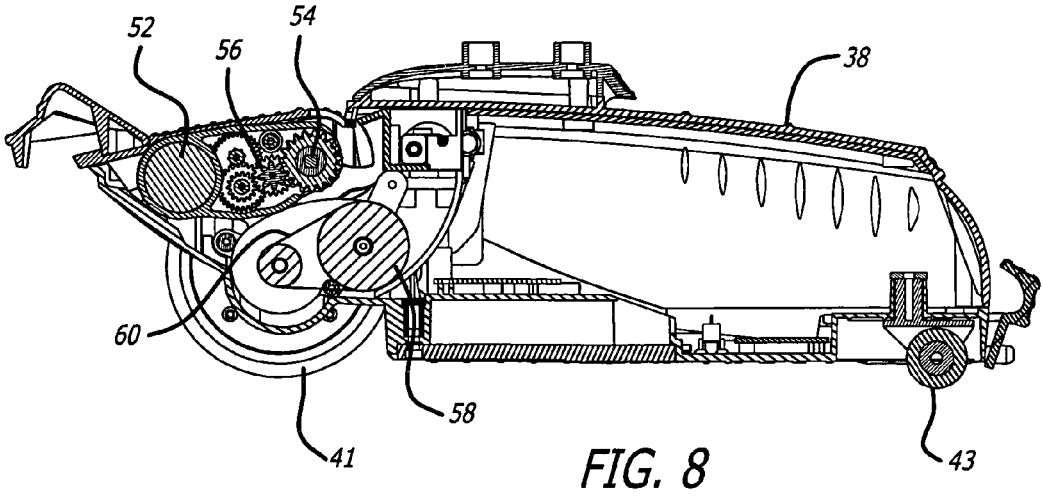
FIG. 8 is a side view showing some of the operating mechanisms for driving the rear wheels and for raising the hood.

FIG. 8 is a partial cross-sectional view showing the step-down mechanism for operating the shaft 54 which raises the hood and also shows one of the motors 58 for driving one of the rear wheels. It may be noted that the motor 52 for rotating the shaft 54 is coupled to the shaft by the step-down gearing assembly 56. Regarding the motor 58, it drives the rear wheel 41 by the belt and pulleys which are shown at reference numeral 60.

FIG. 9 is an exploded view showing the hood 38 spaced apart from the chassis 34 of the vehicle. In the configuration as shown in FIGS. 9 and 10, the motor 52 operates and rotates the shaft 54 following the step-down gearing 56. The subhousing 62 is fixed to the shaft 54 and rotates with it. On the subhousing 62 are cross protrusions 64 mating with cross recesses 66 on the attack vehicle chassis, and the hood 38, respectively. As the entire housing 62 is rotated upwardly, the hood, being coupled to the subhousing 62 by the cross protrusions and recesses 64 and 66, is raised. Similarly, the action FIG. 36 is coupled to housing 62 by the linkage 68 and, concurrently with or following the raising of the hood 38, the action FIG. 36 is raised into a threatening stance.

Figure 11:
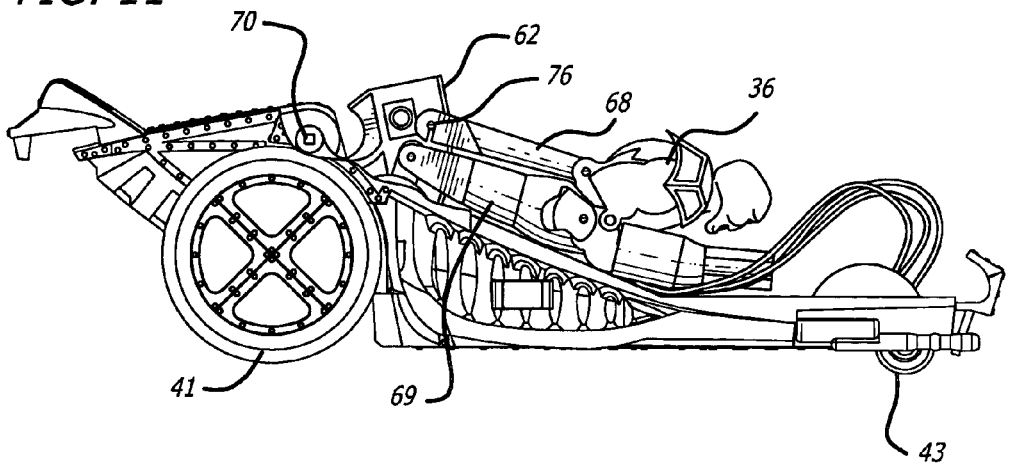
FIGS. 11, 12 and 13 are successive views showing how the action figure is raised concurrently with or after the hood of the vehicle is raised.
Figure 12:
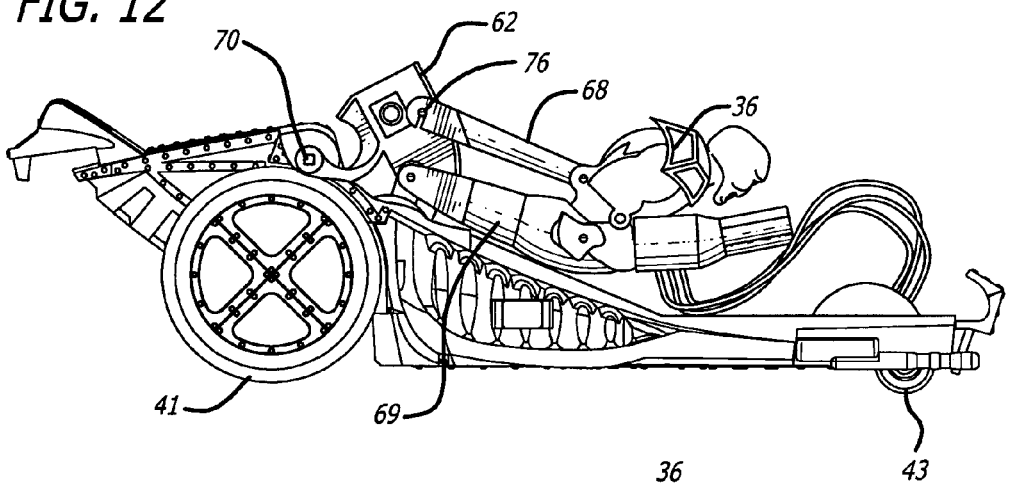
Figure 13:
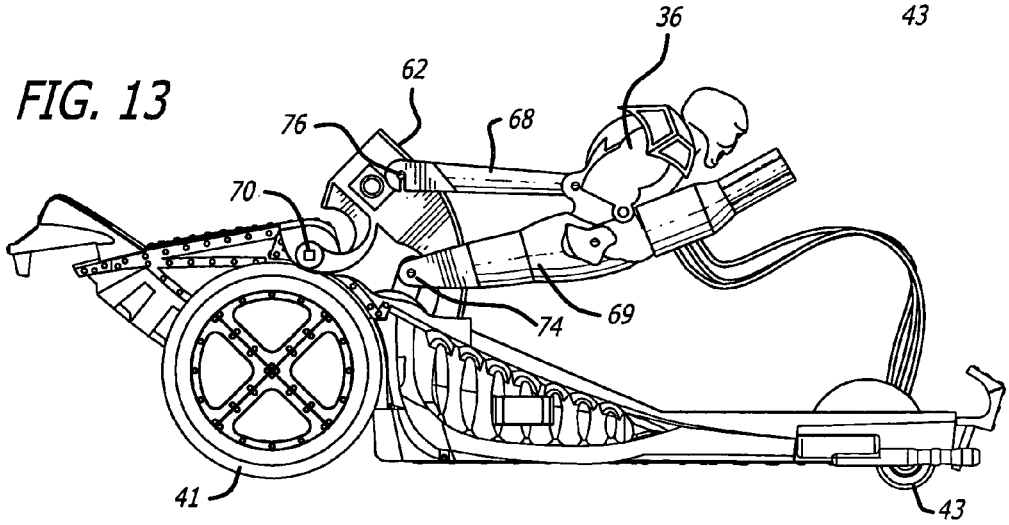

Three successive positions of the action FIG. 36 are shown in FIGS. 11, 12 and 13. More specifically, as the subhousing 62 is rotated about the pivot point 70, the subassembly 62 is raised, and the action FIG. 36, being linked to the subhousing 62 by the linkages 68 and 69, will also rise with successive positions shown in these three figures of the drawing. Incidentally it may be noted that the linkage 69 has a fixed pivot point 74 on the chassis of the attack vehicle, and the other linkage 68 is pivotally coupled to the subassembly 62 at linkage point 76.

Figure 14:
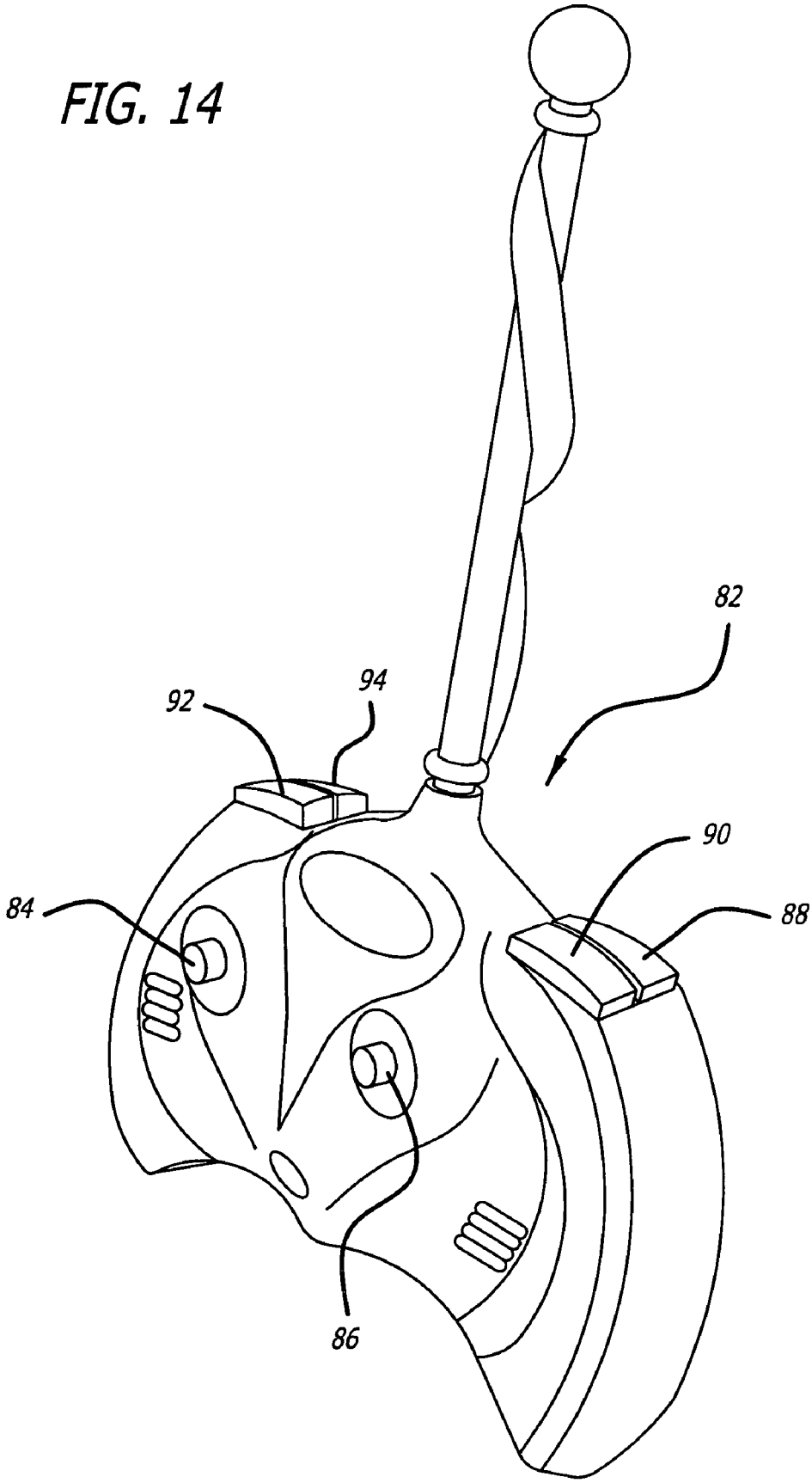
FIG. 14 shows the remote controller with various switches for sending signals to the attack vehicle.

FIG. 14 shows one preferred embodiment for the controller 82. Incidentally the coupling between the controller 82 and the attack vehicle 32 may be by low level radio signals or by infrared or by direct electrical wire connections, or by any other known method. Two joy sticks 84 and 86 are provided each with two positions, to provide forward and reverse rotation signals for each of the two large rear drive wheels 40 and 41. The two switches 88 and 90 are for different weapon sound effects which are provided to simulate use by the action figure of the weapons at his disposal. In addition, the switches 92 and 94 are provided for raising the hood and action figure and for lowering the hood and action figure.

Figure 15:
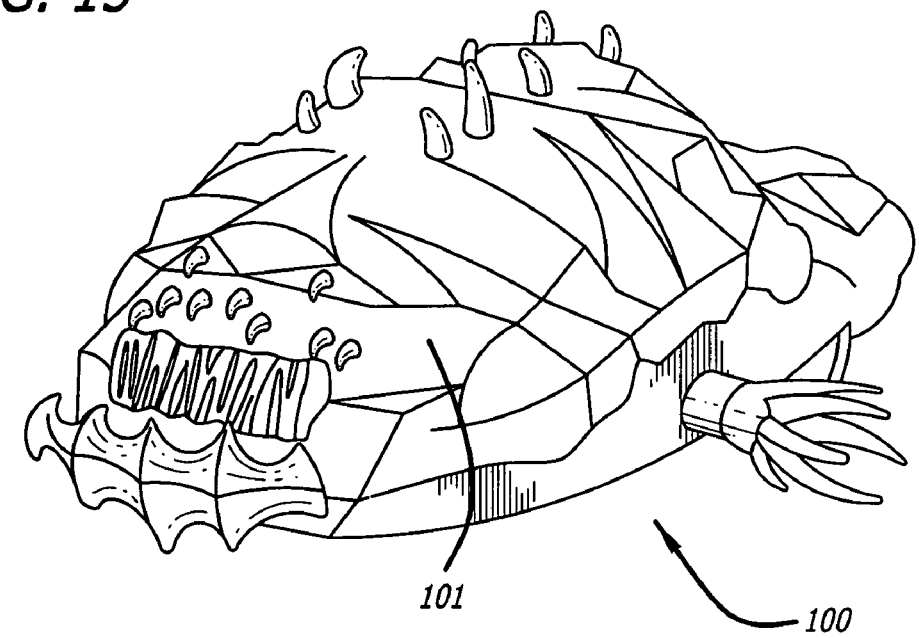
FIGS. 15 and 16 illustrate another embodiment of the invention in which a different action figure and a different external configuration of the vehicle are presented.
Figure 16:
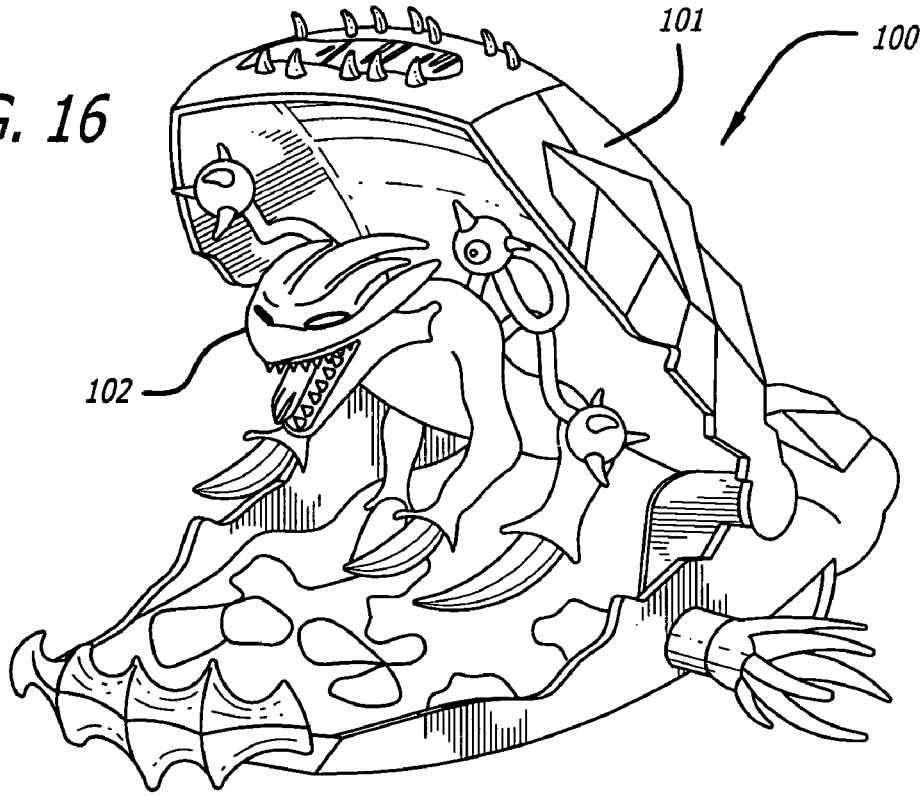

FIGS. 15 and 16 represent another embodiment of the invention in which the attack vehicle 100 has a hood 101 which may be raised to reveal the threatening attack FIG. 102.

Figure 17:
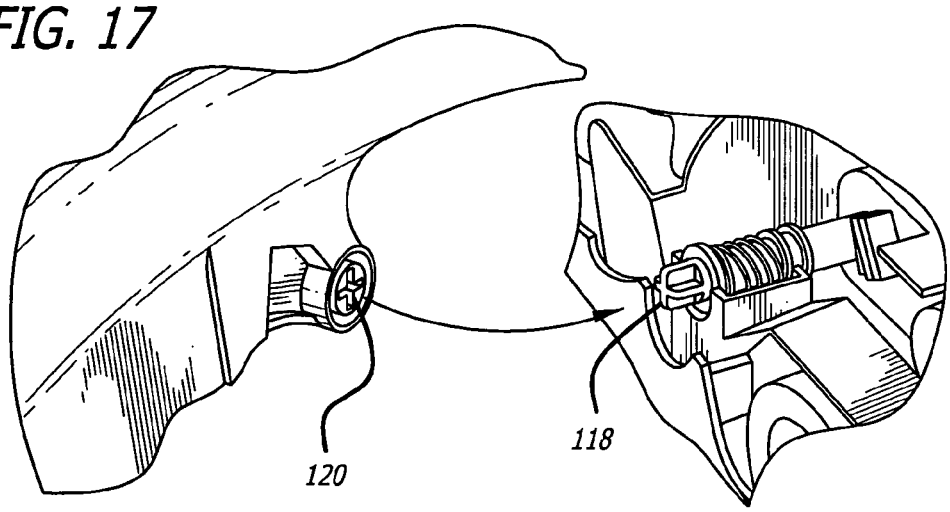
FIG. 17 is an exploded view showing how the hood is mounted to a rotating shaft in the body of the vehicle.
Figure 18:
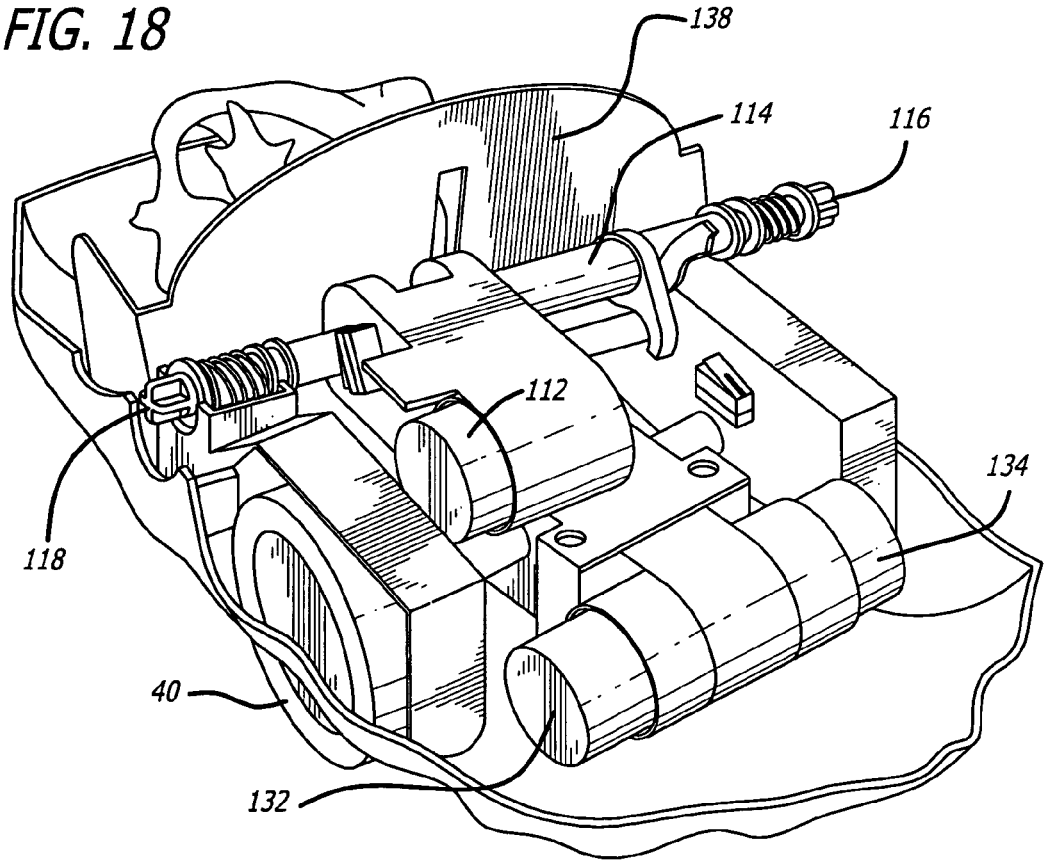
FIG. 18 shows the three motors and how they are mounted in the attack vehicle.

FIGS. 17 and 18 show the mechanism for raising the hood and also for actuating the rear wheels. More specifically, the motor 112 rotates the shaft 114 following a series of step-down gears (not shown). The outer ends of the shaft 114 are provided with a cross set of protrusions 116 and 118 which fit the cross recesses 120 of the hood. FIG. 17 shows one set of cross protrusions 118 and cross recesses 120, but of course there are two such mating couplings. In FIG. 19 the rotating shaft 114 is shown more clearly as being driven by the motor 112 through the step down gearing 113. In FIG. 19 the reference numeral 138 refers to an internal panel within the attack vehicle.

Incidentally, the embodiment of FIGS. 17 and 18 differs from that of FIGS. 1 through 13 in the hood and attack figure actuation. Thus, in the arrangements of FIGS. 1–13 the hood and action figure are coupled to the sub-assembly 62, while in the mechanism of FIGS. 17, 18 and 19, the hood and action figure are coupled directly to the rotating shaft 114. It is also noted that, in both cases, the hood has sufficient flexibility that the two sides may be flexed outward, to permit removal of the hood.

FIG. 20 shows the drive motors 132 and 134 which are coupled respectively to the wheels 40' and 41'. Each motor has an output pulley 142 which is in turn coupled to a respective pulley 144 for driving the wheels 40' and 41'. The pulleys may of course be of different sizes to accommodate the desired drive ratio between the motors 132 and 134 and the respective wheels 40' and 41'.

Figure 21:
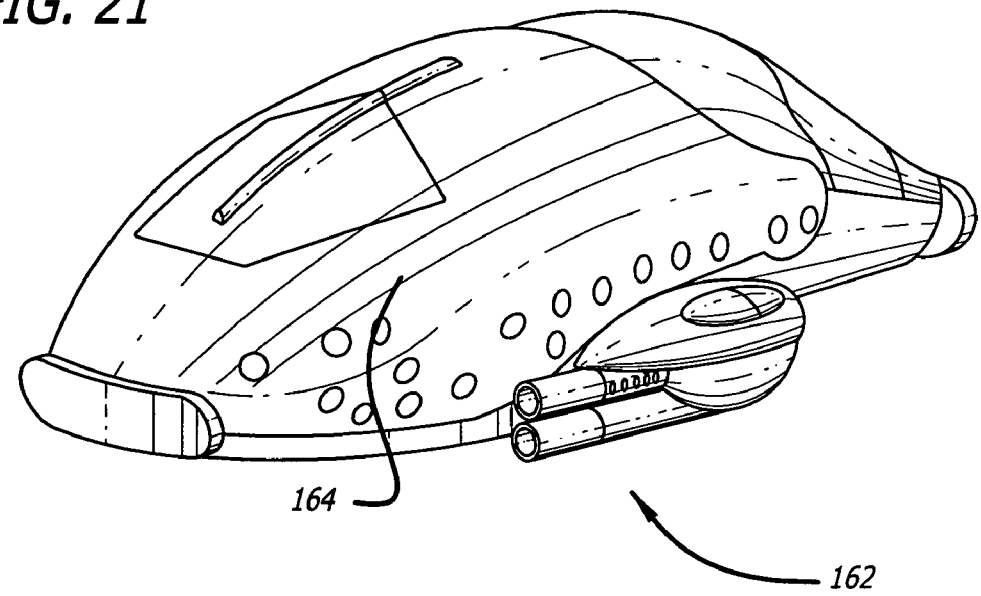
FIGS. 21 and 22 show the exterior configuration, and the exposed action figure, respectively, for a third embodiment of the invention.
Figure 22:
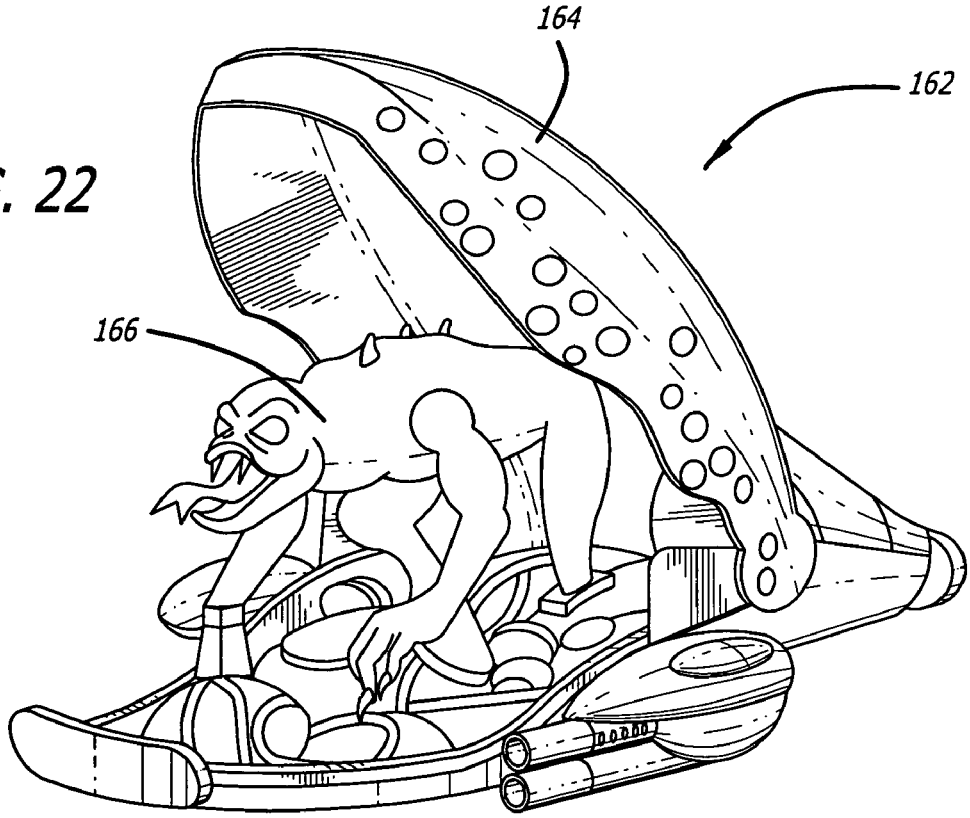

FIGS. 21 and 22 show still another embodiment of the invention with the attack vehicle 162 having a hood 164 which may be raised to reveal the action FIG. 166. The driving mechanism for the hood and the wheels may be any desired type such as those shown for either of the two other attack vehicles and action figures included in the present drawings.

Figure 23:
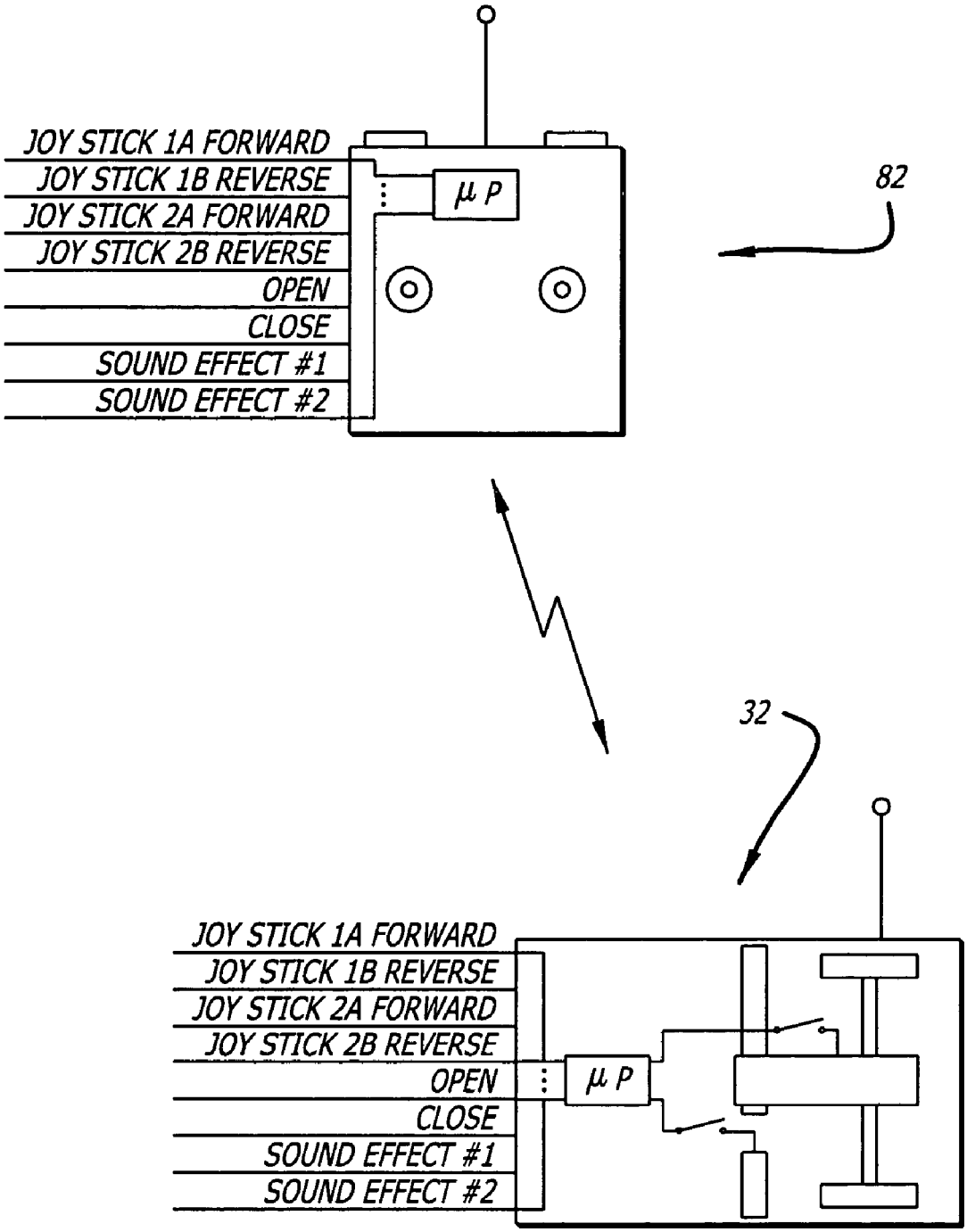
FIG. 23 illustrates schematically the hand held controller and the attack vehicle and the communication which flows from the controller to the vehicle.

Referring now to FIG. 23 of the drawings, it shows the remote controller 82, and the attack vehicle 32 schematically with inputs showing how the controller sends the signals to the attack vehicle and what control signals are employed.

Concerning the two rear drive wheels 40, 41 and the idler wheel 43, together with the drive arrangement for separately powering the drive wheels in the forward or reverse directions, this motive power system has certain special advantages. Specifically, by operating one rear wheel in one direction and the other rear wheel in the opposite direction, rapid swiveling of the vehicle may be accomplished so that the vehicle may be quickly oriented to any desired direction.

It may also be noted that the mounting arrangements for the action figure are such that, in both cases, there is lost motion between the raising of the hood and the raising of the action figure, so that there is substantial clearance between the action figure and the hood.

In conclusion, in the foregoing detailed description and in the drawings, preferred embodiments of the invention have been described. However, it is to be understood that various changes and modifications may be made without departing from the spirit and cope of the invention. Thus, by way of example and not of limitation, other mechanical arrangements may be provided for raising and lowering the hood and the action figure. Also, the vehicle may have four wheels instead of three wheels, and power may be supplied to two wheels, from a single motor, with steering signals optionally being provided. Accordingly, the present invention is not limited to the embodiments as shown and described hereinabove.

What is claimed is:

1. A remotely controlled concealed attack toy vehicle system comprising:

a three wheeled vehicle including first and second drive wheels mounted toward the rear of said vehicle and an idler wheel mounted toward the front of said vehicle;

a hood of substantially innocuous appearance mounted toward the front of the vehicle;

an armed attack figure bearing weapons mounted on the front of the chassis, concealed by said hood when it is in a closed configuration; said figure being spaced from said hood;

a first motor for driving said first drive wheel in the forward or reverse direction;

a second motor for driving said second drive wheel in the forward or reverse direction;

a third motor for raising said hood and for raising said attack figure to a threatening posture;

sound transmitters for simulating firing of weapons held by said attack figure or mounted on said vehicle; and a remote controller for applying control signals to the attack vehicle to (1) selectively actuate the first, second and third motors in the forward or reverse directions, (2) to actuate said sound transmitters; and (3) to raise and lower the hood and the armed attack figure.

2. A remotely controlled concealed attack vehicle system as defined in claim 1 wherein a rotatable shaft is provided, said third motor is coupled to drive said shaft through a gear reduction mechanism, and said hood is coupled to the ends of said shaft for raising and lowering as said third motor is operated; and said figure has a linkage coupled to said shaft for upward movement as the shaft is rotated by said third motor.

3. A remotely controlled concealed attack vehicle system as defined in claim 1 further comprising a lost motion mechanism for delaying movement of said attack figure until after said hood is at least partially raised.

4. An attack toy vehicle system comprising:

a three wheeled vehicle including first and second drive wheels mounted toward the rear of said vehicle and an idler wheel mounted toward the front of said vehicle;

a hood mounted toward the front of the vehicle;

an armed attack figure bearing weapons mounted on the front of the chassis, concealed by said hood when it is in a closed configuration;

said figure being spaced from said hood;

a first motor for driving said first drive wheel in the forward or reverse direction;

a second motor for driving said second drive wheel in the forward or reverse direction;

a third motor for raising said hood and for raising said attack figure to a threatening posture; and at least one sound transmitter for simulating firing of weapons held by said attack figure or mounted on said vehicle.

5. An attack vehicle system as defined in claim 4 wherein a rotatable shaft is provided, said third motor being coupled to drive said shaft through a gear reduction mechanism, and said hood is coupled to the ends of said shaft for raising and lowering as said third motor is operated; and wherein said figure has a linkage coupled to said shaft for upward movement as the shaft is rotated by said third motor.

6. An attack vehicle system as defined in claim 4 further comprising a lost motion mechanism for delaying movement of said attack figure until after said hood is at least partially raised.

7. An attack vehicle as defined in claim 4 wherein additional simulated weapons are mounted on the outside of said vehicle.

8. An attack toy vehicle system comprising:

a wheeled vehicle;

a hood mounted toward the front of the vehicle;

an armed attack figure mounted toward the front of the vehicle concealed by said hood when it is in a closed configuration;

said figure being spaced from said hood; and an electromechanical mechanism for raising said hood and for raising said attack figure to a threatening posture, comprising a motor coupled to drive a rotatable shaft through a gear reduction mechanism, said hood being coupled to said shaft for raising and lowering as said motor is operated, said figure having a linkage coupled to said shaft for upward movement as the shaft is rotated by said motor.

9. An attack vehicle system as defined in claim 8 further comprising a lost motion mechanism for delaying movement of said attack figure until after said hood is at least partially raised.

10. An attack vehicle system as defined in claim 8 further including a remote controller for sending signals to raise the hood and the action figure and to drive the wheels of said wheeled vehicle.

11. An attack vehicle system as defined in claim 8 wherein said action figure has two pivot points, one being fixed to the chassis of said vehicle, and the other being movable.

12. An attack vehicle system as defined in claim 8 wherein said vehicle has two independently driven rear wheels and one swivelable front wheel which is less than one half the size of said rear wheels.

13. An attack vehicle system as defined in claim 8 wherein said figure is equipped with weapons.

14. An attack vehicle system as defined in claim 8 further comprising weapons mounted on the outside of said vehicle.

15. An attack vehicle system as defined in claim 8 wherein radio controlled communication circuitry is provided between a remote controller and said vehicle.

16. An attack vehicle system as defined in claim 15 wherein said circuitry includes a remote controller with two joysticks for controlling forward and reverse actuation of two rear wheels of said vehicle.

17. An attack vehicle system as defined in claim 8 wherein said hood is flexible so that it may be flexed to permit removal from said vehicle.

18. An attack vehicle system as defined in claim 8 wherein said electromechanical mechanism rotates a pivot actuation part which mates with a corresponding actuation part on said hood to facilitate raising said hood, and permits the removal of said hood.

19. An attack vehicle system as defined in claim 8 wherein said system includes a remote controller for raising and lowering said hood and said attack figure.

* * * * *